US011195503B2

(12) United States Patent
Bruen

(10) Patent No.: US 11,195,503 B2
(45) Date of Patent: Dec. 7, 2021

(54) MAGNETIC PICKUP POSITIONING MECHANISM FOR ELECTRIC MUSICAL INSTRUMENTS

(71) Applicant: Justin Richard Bruen, Bellvue, CO (US)

(72) Inventor: Justin Richard Bruen, Bellvue, CO (US)

( * ) Notice: Subject to any disclaimer, the term of this patent is extended or adjusted under 35 U.S.C. 154(b) by 0 days.

(21) Appl. No.: 16/834,825

(22) Filed: Mar. 30, 2020

(65) Prior Publication Data

US 2021/0304720 A1 Sep. 30, 2021

(51) Int. Cl.
*G10H 3/18* (2006.01)

(52) U.S. Cl.
CPC ..... *G10H 3/183* (2013.01); *G10H 3/181* (2013.01); *G10H 2220/461* (2013.01)

(58) Field of Classification Search
CPC ... G10H 3/183; G10H 3/181; G10H 2220/461
USPC ..... 84/727
See application file for complete search history.

(56) References Cited

U.S. PATENT DOCUMENTS 2,964,985 A * 12/1960 Webster ..... G10H 3/183 84/723
3,538,807 A * 11/1970 Francis ..... G10D 1/08 84/267
3,763,736 A * 10/1973 Williams ..... G10H 3/181 84/329
3,780,202 A * 12/1973 Law ..... G10H 3/183 84/726
3,911,777 A * 10/1975 Rendell ..... G10H 3/183 84/743
4,227,434 A * 10/1980 DiMarzio ..... G10D 3/00 84/723
4,261,240 A * 4/1981 Aaroe ..... G10H 3/183 84/726
4,616,548 A * 10/1986 Anderson ..... G10H 3/18 84/743
4,869,144 A * 9/1989 Lieber ..... G10H 3/183 84/726
5,012,716 A * 5/1991 Pagelli ..... G10H 3/182 84/727
5,052,269 A * 10/1991 Young, Jr. ..... G10D 1/085 84/728
5,072,646 A * 12/1991 Valkama ..... G10H 3/183 84/726
6,992,243 B2 * 1/2006 Small ..... G10H 3/183 84/267
7,060,888 B2 * 6/2006 Spalt ..... G10H 3/183 84/727
7,145,063 B2 * 12/2006 Redard ..... G10H 1/32 84/267

(Continued)

*Primary Examiner* — Christina M Schreiber

(57) ABSTRACT

The magnetic pickup positioning mechanism for electric musical instruments is mounted beneath the strings between the neck and bridge of an electric musical instrument like the electric guitar or bass. It includes a length of "C" profile track fastened to the guitar and one or more slide-swivel assemblies that twist-lock into, slide and rotate along the track. Magnetic pickups are mounted to the slide-swivel assemblies that allows the player to use their hand to slide and rotate the pickups to various positions and angles between the neck and bridge in order to get a wide variety of tones.

1 Claim, 4 Drawing Sheets

(56) References Cited

U.S. PATENT DOCUMENTS

| | | | | |
|---|---|---|---|---|
| 7,453,033 | B2 * | 11/2008 | Redard | G10H 3/183 84/213 |
| 9,047,852 | B2 * | 6/2015 | Canavan | G10H 3/12 |
| 9,401,134 | B2 * | 7/2016 | Baker | G10H 3/22 |
| 10,276,142 | B2 * | 4/2019 | Ma | G10H 3/181 |
| 10,607,588 | B2 * | 3/2020 | Berg | G10H 3/181 |
| 2012/0210848 | A1 * | 8/2012 | Yamanaka | H01R 13/6205 84/726 |
| 2015/0000508 | A1 * | 1/2015 | Canavan | G10H 3/183 84/743 |
| 2016/0027422 | A1 * | 1/2016 | Baker | G10H 3/22 84/726 |
| 2018/0197518 | A1 * | 7/2018 | Ma | G10H 3/183 |
| 2021/0304720 | A1 * | 9/2021 | Bruen | G10H 3/181 |

* cited by examiner

MAGNETIC PICKUP POSITIONING MECHANISM FOR ELECTRIC MUSICAL INSTRUMENTS

BACKGROUND OF THE INVENTION

1. Field of the Invention

The Magnetic Pickup Positioning Mechanism for Electric Musical Instruments is relevant to the field of electric musical instruments, in particular in expanding the tonal variety of an electric guitar or bass by allowing the player to slide and rotate the pickups to various positions between the neck and the bridge.

2. Discussion of the Prior Art

Several inventions have allowed a player to move a pickup to different positions beneath the strings of an electric musical instrument; however, this invention is unique from the prior art due to a mechanism that allows a player to slide and rotate multiple pickups to different positions in order to achieve distinctive tones.

A distinction from the prior art is evident where the pickup is mounted to a single spring-loaded slide-swivel that twist-locks into the slot of the track and slides and rotates together as a single unit along the length of the track. The shaft on the slider is centered beneath the pickup so that the pickup stays centered with the track as it moves. Because the track is centered with the strings, a player can move the pickup without potentially drifting from the center of the strings.

In contrast, prior art mounting pickups have used two tracks and two slides, necessitated by the mounting plates at each end of the magnetic pickup. For the pickup to rotate, the mounting plates must be able to swivel and slide across the linear slides captured inside the tracks. This has required that the mounting plates have slotted holes where they attach to the linear motion slides. These slotted holes allow the pickup to move sideways from the center of the strings, a motion that may be undesirable to players who desire a centered pickup that is typically the preferred position.

BRIEF SUMMARY OF THE INVENTION

The Magnetic Pickup Positioning Mechanism for Electric Musical Instruments expands the tones available from an electric instrument, like guitar or bass, by allowing the player to slide and rotate the pickups by hand into various positions between the neck and bridge of the instrument.

A single track is mounted onto or into the body of the instrument, underneath the strings, lengthways between the neck and bridge. The track holds and guides the pickup slide assemblies onto which standard guitar pickups are mounted. The pickup slide assemblies are spring loaded and twist-lock into the track without requiring tools.

The track will accommodate multiple pickup slide assemblies providing the player with tonal switching options like series, parallel, and phased.

DETAILED DESCRIPTION OF THE PREFERRED EMBODIMENT

Figure 1:
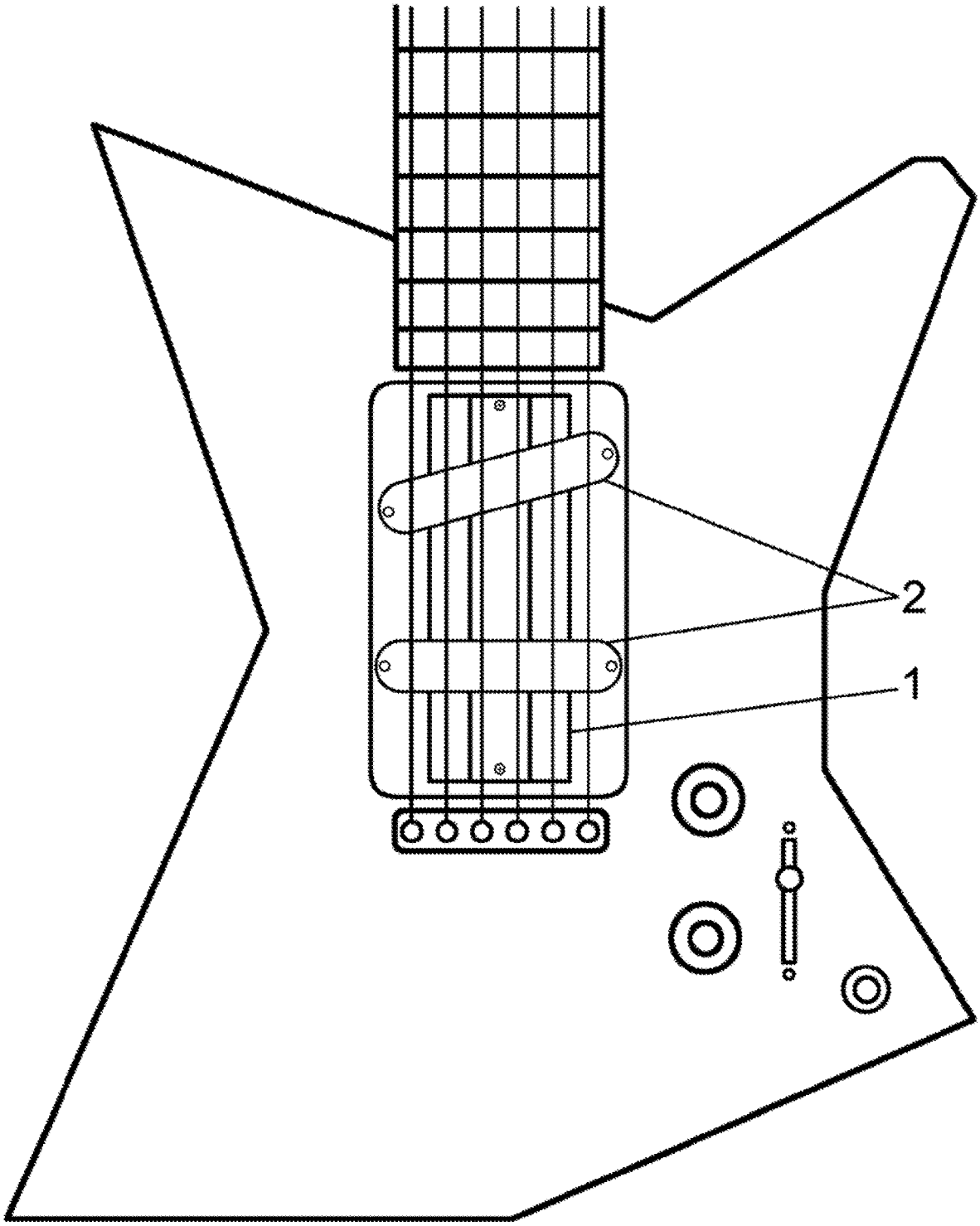
FIG. 1 is a top view of the invention mounted beneath the strings in a cavity in the body of an electric guitar.

FIG. 1 is a top view of the invention mounted in a cavity in the body of an electric guitar. The track (1) mounts with the opening oriented up and lengthways beneath the strings between neck and bridge, typically in a cavity in the body of the guitar. The opening of the track should be centered beneath the strings so that the pickup will also be centered beneath the strings. The track can be mounted to the body with adhesive, hardware, or any other suitable mean, but mounting hardware should only be placed at the ends of the track so as not to interfere with the movement of the slide-swivel assembly. Two slide-swivel assemblies (2) are shown positioned in different places along the track to illustrate direction of slide along the opening and axis of rotation.

Figure 2:
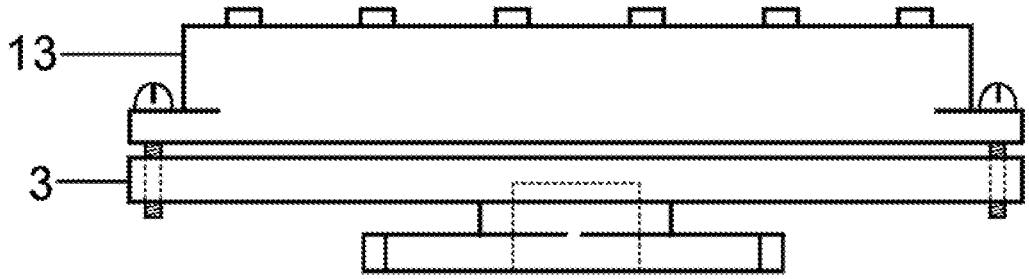
FIG. 2 is a side view of a magnetic pickup mounted to the slider.

FIG. 2 is a side view of how a magnetic pickup (13) mounts to the slider (3).

Figure 3:
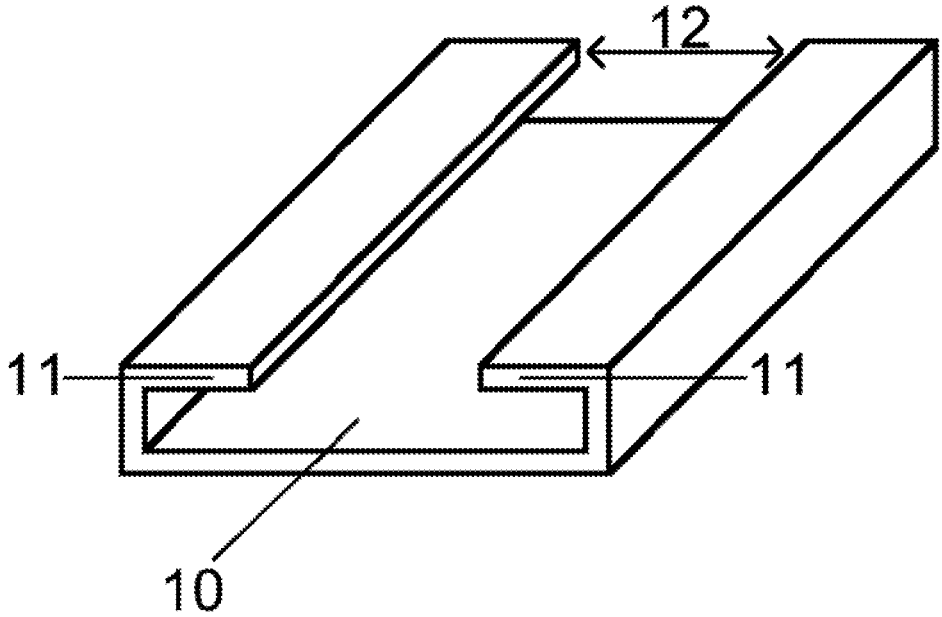
FIG. 3 is a perspective view of the "C" profile track.

FIG. 3 is a perspective view of the "C" profile track. The parts of the track that are referred to later in this description are the floor of the track (10), the returns of the track (11), and the opening of the track (12) which is the open space between the returns of the track.

Figure 4:
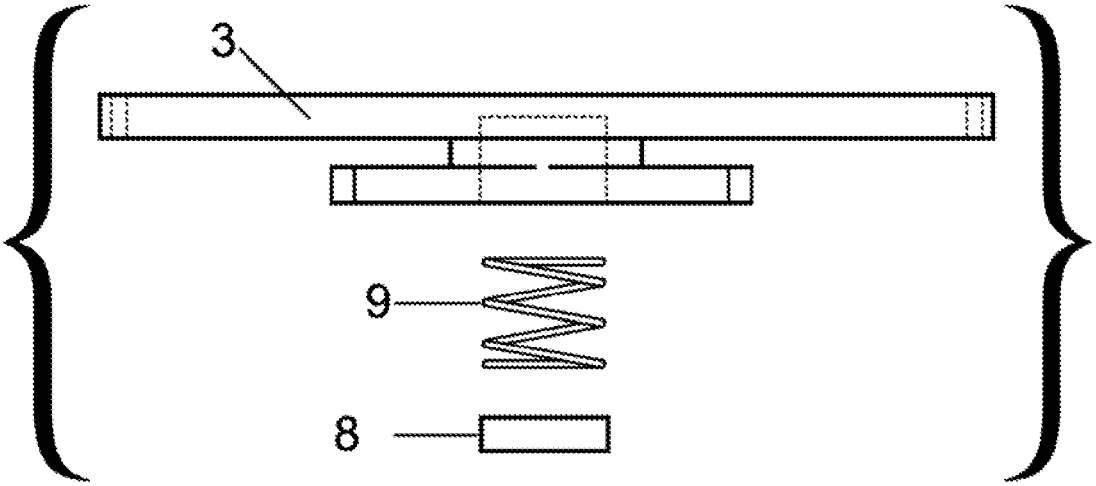
FIG. 4 is an expanded side view of the slide-swivel assembly.

FIG. 4 is an expanded side view of the slide-swivel assembly which includes the slider (3), the spring (9), and the glide disc (8). The spring and glide disc fit into the cavity (7) of the slider when the slider is inserted into the track.

Figure 5:
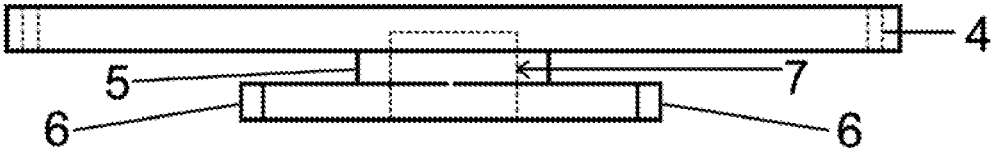
FIG. 5 is a side view of the slider.

FIG. 5 is a side view of the slider (3) which has three sections, the mounting plate with pickup mounting holes (4), the cylindrical slide-swivel shaft (5), and the locking tabs (6). There is a cavity through the center of the slide-swivel shaft and locking tabs that houses the spring and glide disc.

Figure 6:
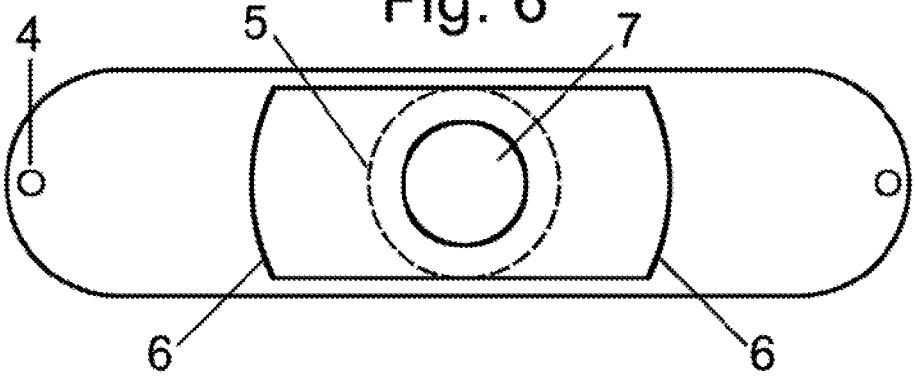
FIG. 6 is a bottom view of the slider in FIG. 5

FIG. 6 is a bottom view of the slider in FIG. 5

Figure 7:
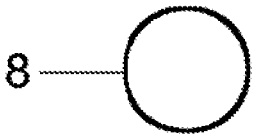
FIG. 7 is top view of the glide disc.

FIG. 7 is top view of the glide disc (8) which is cylindrical in shape. It has a slightly smaller diameter than the cavity in the slider so that it fits freely into the cavity. The glide keeps the spring from touching the track. Ideally it is made from a low friction or self-lubricating material. It should not be made from a material that will scratch the track when the slide-swivel assembly is moved.

Figure 8:
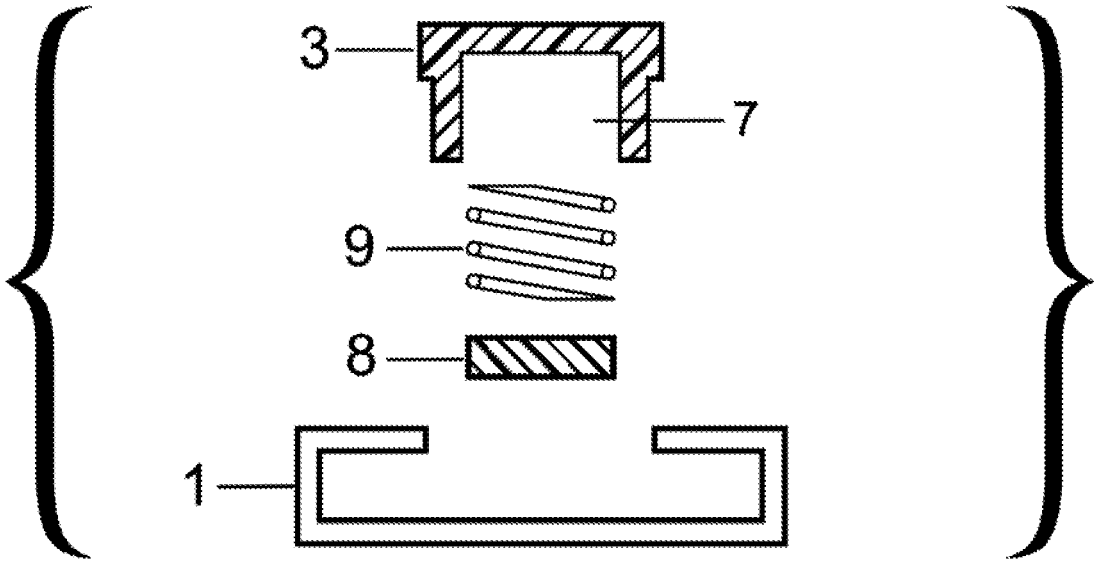
FIG. 8 is an expanded cross sectional end view of the slide-swivel assembly with the ends rotated parallel with the opening of the track. This is the way the slide-swivel assembly is oriented for insertion into or removal from the track.

FIG. 8 is an expanded cross sectional end view of the slide-swivel assembly and locking tabs aligned parallel with the opening of the track. This is the way the slide-swivel assembly is oriented for insertion into and removal from the track.

Figure 9:
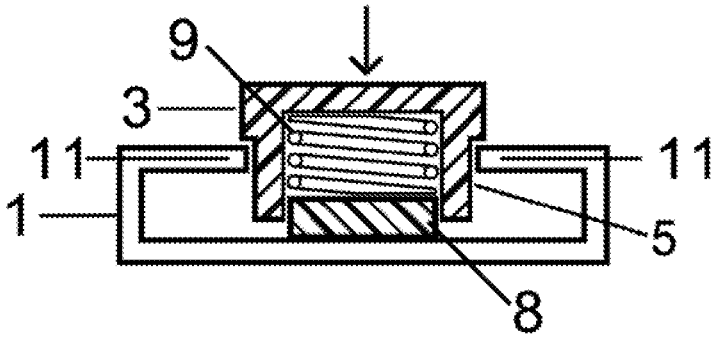
FIG. 9 is a cross sectional end view of the slide-swivel assembly inserted into the track.

FIG. 9 is a cross sectional end view of the slide-swivel assembly inserted into the track (1). In this orientation the locking tabs of the slider (3) extend lengthways in the same direction as the opening of the track. The width of the locking tabs is equal to the diameter of the slide-swivel shaft (5) and slightly smaller than the opening of the track between the returns (11). This allows the locking tabs to fit down through the opening and into the wider interior of the track. The round slide-swivel shaft (5) occupies the opening of the track and slides and rotates along the opening. The slide-swivel assembly locks into the track when it is rotated away from parallel with the track so that the locking tabs extend beneath the returns of the track (see FIG. 10).

Figure 10:
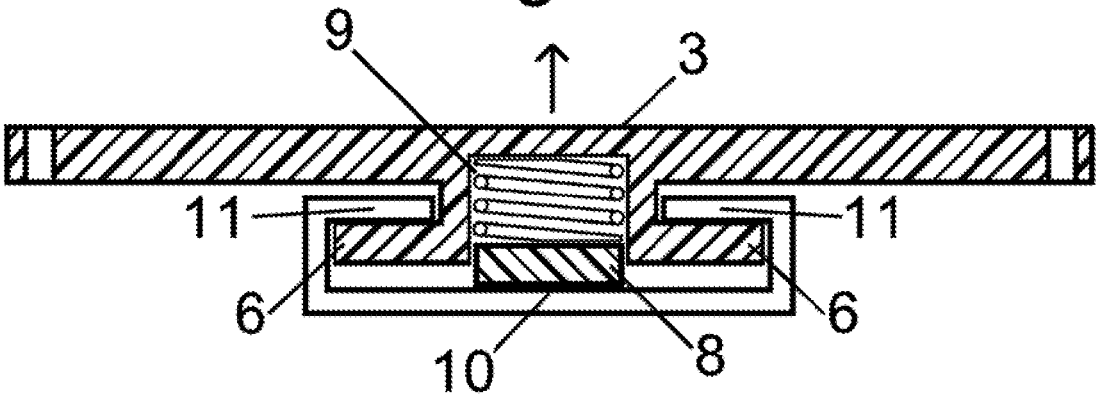
FIG. 10 is a cross sectional side view of the slide-swivel assembly with ends rotated perpendicular to the track so that the locking tabs extend into the pockets of the track.

FIG. 10 is a cross sectional side view of the slide-swivel assembly rotated perpendicular to the track (1) so that the locking tabs (6) extend beneath the returns of the track (11). The compressed spring (9) pushes the glide disc (8) down onto the floor of the track (10). In turn, the spring pushes up on the top of the cavity inside slider (3) which causes the locking tabs (6) on the slider (3) to press up against the returns of the track (11) which creates enough friction to keep the slider from moving freely. The ideal spring provides tension small enough that the player can slide and rotate the slide-swivel assembly along the track by hand, but great enough to hold it in place even during most vigorous playing.

The invention claimed is:

1. A musical instrument magnetic pickup positioning mechanism comprising: a single length of track with a "C" profile that mounts beneath strings, within a body of an electric musical instrument, lengthways between a neck and bridge of said electric musical instrument; a slide-swivel assembly on which a magnetic pickup is mounted and twist-locks into the track and slides and rotates along the length of the track when pushed by a player's hand.

* * * * *